US008469725B2

(12) United States Patent
Walls, Jr.

(10) Patent No.: US 8,469,725 B2
(45) Date of Patent: Jun. 25, 2013

(54) ADAPTER FOR ELECTRIC DRYERS

(76) Inventor: Ferdinand Walls, Jr., Madera, CA (US)

( * ) Notice: Subject to any disclaimer, the term of this patent is extended or adjusted under 35 U.S.C. 154(b) by 0 days.

(21) Appl. No.: 12/383,681

(22) Filed: Mar. 27, 2009

(65) Prior Publication Data

US 2012/0220167 A1 Aug. 30, 2012

Related U.S. Application Data

(60) Provisional application No. 61/072,150, filed on Mar. 28, 2008.

(51) Int. Cl.
*H01R 13/648* (2006.01)

(52) U.S. Cl.
USPC ..... 439/105; 439/650; 439/651; 439/655

(58) Field of Classification Search
USPC ..... 439/105, 650–655
See application file for complete search history.

(56) References Cited

U.S. PATENT DOCUMENTS 2,792,557 A * 5/1957 Dowick ..... 439/105
3,349,363 A * 10/1967 Goodman ..... 439/105

* cited by examiner

*Primary Examiner* — Ross Gushi
(74) *Attorney, Agent, or Firm* — Richard A. Ryan

(57) ABSTRACT

An adapter for use in combination with an electric dryer to electrically connect the dryer to an outlet when the pattern of the prongs on the power cord plug do not correspond to the pattern of the prong-receiving receptacle openings at the outlet. In the preferred embodiment, the adapter comprises an adapter body having a plurality of prong-receiving openings on its outward face and a plurality of adapter prongs on its rearward face. The prong-receiving openings are in a first prong pattern that corresponds to the number and/or configuration of the prongs on the plug and the adapter prongs are in a second prong pattern that corresponds to the number and/or configuration of the receptacle openings on the outlet to electrically interconnect the plug and the outlet. In one embodiment, the adapter also includes a connecting wire inside the adapter body and a ground wire to ground the dryer.

9 Claims, 3 Drawing Sheets

ADAPTER FOR ELECTRIC DRYERS

CROSS-REFERENCE TO RELATED APPLICATIONS

This patent application claims priority to U.S. Provisional Patent Application No. 61/072,150 filed Mar. 28, 2008.

STATEMENT REGARDING FEDERALLY SPONSORED RESEARCH

Not Applicable.

BACKGROUND OF THE INVENTION

A. Field of the Invention

The field of the present invention relates generally to adapters for electrically connecting an object to an electrical outlet. In particular, the present invention relates to electrical adapters that are utilized to connect an electrical plug having a first configuration to a receptacle having a second, non-conforming configuration. Even more particularly, this invention relates to such electrical adapters for use with dryers having an electrical cord with either a four or three prong plug configuration that must plug into an outlet having a receptacle with either three or four, respectively, prong-receiving openings.

B. Background

For many years, a large percentage of the population in the United States has primarily used electrically powered dryers for drying clothes, bedding, shoes and other materials. A power cord connects the electric dryer to a source of electrical power, which is typically a wall mounted electrical outlet. Because of the higher electrical load requirements, electric dryers have historically utilized a power cord having a specially configured three-prong plug that is received into a cooperatively configured three-prong receptacle. As a result, most older homes were built with an electrical outlet having a three-prong receptacle in the area where the electric dryer was placed. Since approximately 1996, however, nearly all municipal electrical codes require four-prong receptacles at the electrical outlet to which the dryer connects and use of a cooperatively configured four-prong plug for the electric dryer power cord. In addition to the black and red power wires and the white neutral wire, the four-prong power cord has a green ground wire that does not carry any current and is, instead, grounded back to the junction box or to a separate ground. Inside the dryer, the white neutral wire is not bonded to the chassis and the green wire is grounded from the wiring terminals.

Most homes built prior to 1996 have the three-prong receptacle for the electric dryer, which will not work with the four-prong plugs that are required for newer dryers. Because so many older homes have a three-prong receptacle, most municipal codes allow the dryer to be rewired for use with a power cord having a three-prong plug. Rewiring the electric dryer involves disconnecting the separate ground strap and connecting it to the neutral white wire, which in effect reverts the dryer wiring arrangement to the pre-1996 configuration. As a result, most dryer manufactures configure their dryers to work with either a three-prong or a four-prong power cord. Typically, this requires the manufacturer or retailer to deliver the dryer to the home with both of these power cords and then rewire the dryer at the purchaser's home for use with either a three-prong receptacle or a four-prong receptacle, depending which receptacle is being utilized in the home. Although the home could be rewired to replace the three-prong receptacle with a four-prong receptacle, municipal codes generally do not require such rewiring and, as a result, most homeowners do not want to incur the expense associated with rewiring their home.

There are many different types of electrical adapters which are commonly utilized to interconnect a power cord having a plug of a particular prong configuration with a built-in receptacle having prong openings of a different, non-conforming configuration. Most users are familiar with an electrical adapter that allows a user to plug a three-prong plug, used on most appliances today, to an outlet having a receptacle with only two prong openings. Typically, these adapters wire the third, neutral wire to a grounding wire or clip that is connected to the center screw that attaches the outlet plate to the electrical box in which the receptacle is mounted. As would be readily apparent to those skilled in the art, the use of a straight adapter that connects a four-prong plug to an outlet having a three-prong receptacle would either leave the ground circuit completely open or would require connecting the ground wire to the neutral wire at the outlet. Such a wiring arrangement is likely to violate electrical codes and could be unsafe as it could pose an electrical shock hazard to the user.

What is needed, therefore, is an electrical adapter that safely and simply allows a user to connect a power cord having a four-prong plug to an outlet having a three-prong opening receptacle or allows a user to connect a power cord having a three-prong plug to an outlet having a four-prong opening. The preferred adapter should be configured to allow a user to quickly and without any rewiring of the dryer or the outlet connect a four-prong plug to a receptacle having only three prong openings or allow the user to connect a three-prong plug to a receptacle having four prong openings. The electrical adapter should be configured to safely interconnect the dryer power cord to the outlet so the user will not be exposed to the risk of an electrical shock. Preferably, the electrical adapter will be configured to allow the user, or someone on his or her behalf, to simply connect the more modern four-prong plug on a dryer power cord to the older style outlets having only three prong openings or connect an older three-prong plug on a dryer cord to the newer style outlet having four prong openings.

SUMMARY OF THE INVENTION

The adapter for electrical dryers of the present invention provides the benefits and solves the problems identified above. That is to say, the present invention discloses an electrical adapter that allows the user to easily, quickly and safely plug a dryer power cord having a modern four-prong arrangement into the older style outlets having a three-prong opening configuration or plug a dryer power cord having an older style three-prong arrangement into a newer style outlet having a four-prong opening configuration. The adapter of the present invention does not require any rewiring of the dryer or the outlet in order to connect a four-prong plug to a receptacle having only three prong-receiving openings or to connect a three-prong plug to a receptacle having four prong-receiving openings. The electrical adapter of the present invention interconnects a dryer power cord having a four or three prong configuration to an outlet having a receptacle with a three or four, respectively, prong-receiving configuration in a manner that reduces the likelihood the user could be injured due to an electrical shock.

In a primary embodiment of the present invention, the adapter for use with a dryer power cord generally comprises a body member having an outward face at a first end and a rearward face at a second end, a plurality of prong-receiving openings in the outward face of the body member and a plurality of adapter prongs at the rearward face of the body member. The plurality of prong-receiving openings are disposed in a first prong pattern that corresponds to the pattern, meaning the number and/or configuration, of the plurality of plug prongs on the power cord plug. The plurality of outwardly extending adapter prongs are disposed in a second prong pattern that corresponds to the pattern, also meaning the number and/or configuration, of the plurality of receptacle openings at the outlet. In one specific configuration the adapter has four prong-receiving openings in the outward face of the body member that are disposed in a first prong pattern which is in corresponding relation to the pattern of the plug prongs on the power cord plug and three outwardly extending adapter prongs on the rearward face of the body member that are disposed in a second prong pattern which is in corresponding relation to the pattern of the receptacle openings at the outlet. In another specific configuration, the adapter has three prong-receiving openings in the outward face of the body member in a first prong pattern that is in corresponding relation to the plug prongs on the plug of the power cord, four outwardly extending adapter prongs on the rearward face of the body member in a second prong pattern that is in corresponding relation to the receptacle openings of the outlet, a ground wire extending outwardly from the body member to connect to the dryer, a connecting means associated with the body member for electrically connecting one of the adapter prongs to the ground wire, an attachment means on the ground wire for attaching the ground wire to the dryer and an extending means associated with the body member for retractably extending the ground wire from the body member to the dryer. The connecting means can be a wire, rod or the like and the attachment means can be a Y-shaped, eyelet-shaped or other connector used with a screw or bolt to connect the ground wire to a metal component of the dryer. Preferably, the extending means is of the type that automatically retracts the ground wire when not attached to the dryer or which retracts the unneeded portion of the ground wire when the ground wire is attached to the dryer to reduce or eliminate any loose wire between the adapter and the dryer.

Accordingly, the primary aspect of the present invention is to provide an adapter for use with electric dryer power cords that provides the benefits described above and solves the problems associated with presently available devices and methods of connecting an electric dryer power cord to an outlet.

It is an important aspect of the present invention to provide an adapter that allows the user to quickly, easily and with relatively low cost connect an electric dryer power cord to an outlet when the power cord has a prong configuration which is different than the prong-receiving receptacle of the outlet.

It is also an important aspect of the present invention to provide an adapter that allows a user to connect a dyer power cord having a four-prong configuration to an outlet configured with a receptacle having three prong-receiving openings.

Another important aspect of the present invention is to provide an adapter that allows a user to connect a dyer power cord having a three-prong configuration to an outlet configured with a receptacle having four prong-receiving openings.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The accompanying figures are merely illustrative of one or more of the preferred embodiments and, as such, represent one or more ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show certain mechanisms to connect a ground wire to the dryer, those who are skilled in the art will readily understand that this is merely for purposes of simplifying the present disclosure and that the present invention is not so limited.

Figure 1:
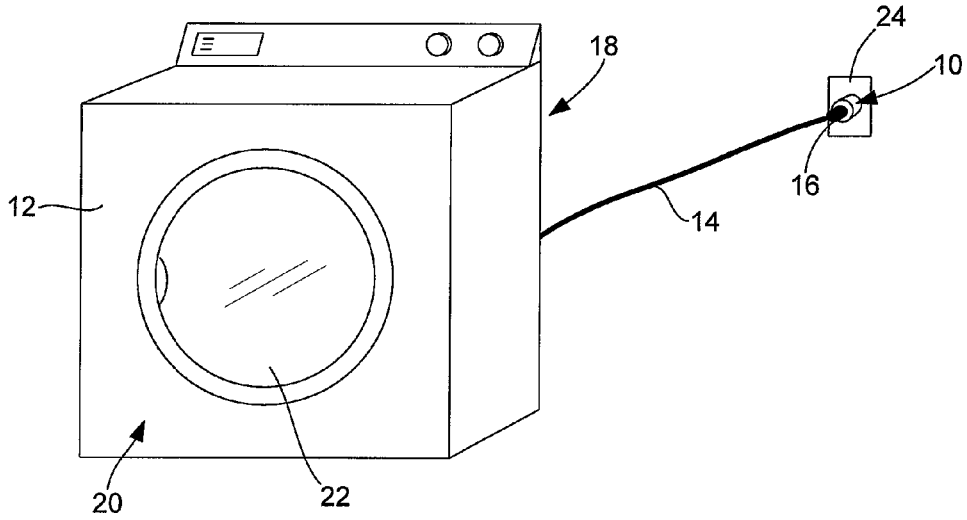
FIG. 1 is a perspective view of a first embodiment of the electrical adapter of the present invention shown interconnecting a four-prong power cord from a dryer to an outlet having three prong-receiving openings.
Figure 2:
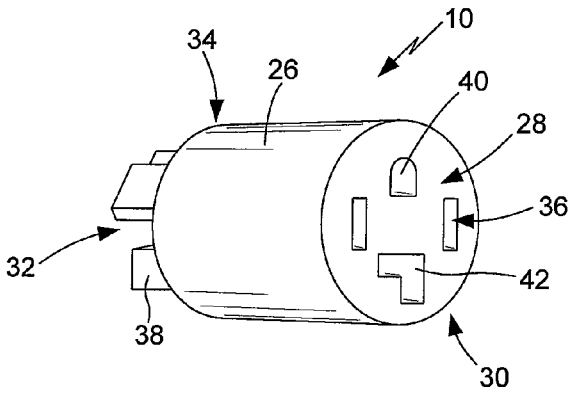
FIG. 2 is a perspective view of the adapter of FIG. 1.
Figure 3:
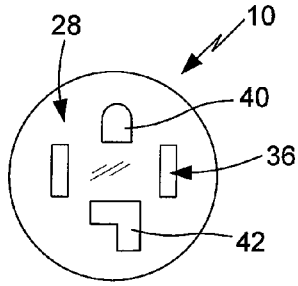
FIG. 3 is front view of the adapter of FIG. 2.
Figure 4:
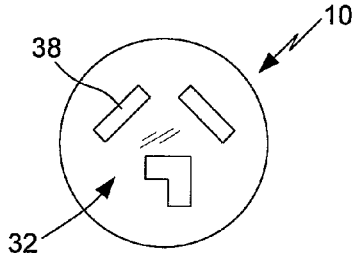
FIG. 4 is a back view of the adapter of FIG. 2.
Figure 5:
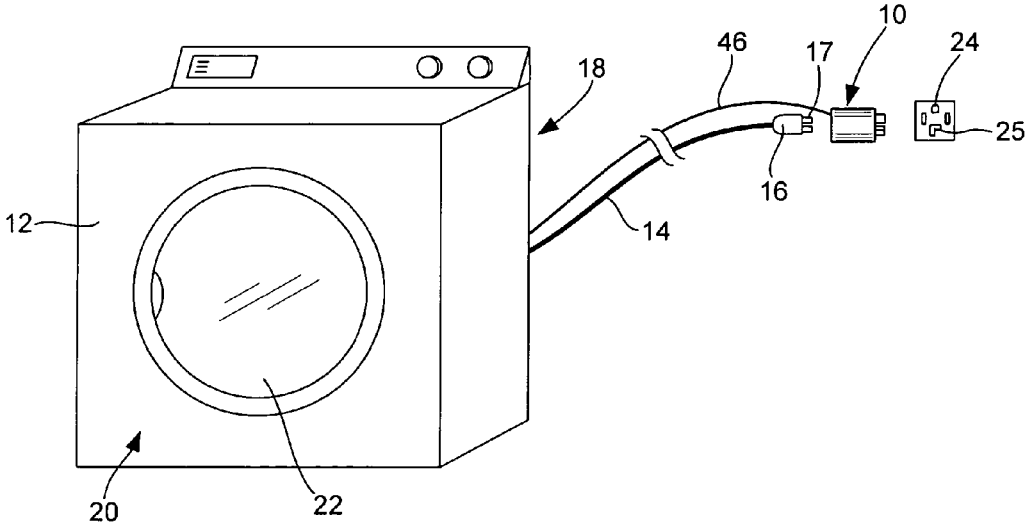
FIG. 5 is a perspective view of a second embodiment of the electrical adapter of the present invention shown interconnecting a three-prong power cord from a dryer to an outlet having four prong-receiving openings.

An adapter for use with electric dryers that is configured pursuant to one embodiment of the present invention is shown generally as 10 in the figures. As shown in FIGS. 1 and 5, adapter 10 is configured for use with an electric dryer 12 having a power cord 14 with a cord plug 16 on the end thereof having four prong members (for the embodiment of FIGS. 1 through 4) or three prong members (for the embodiment of FIGS. 5 through 9), with the plug prongs being collectively identified as 17, extending outwardly from the plug 16. The power cord 14 shown in FIG. 1 extends outwardly from the back end 18 of the dryer 12, with the front end 20 being the end that typically has a door 22 through which clothes and other articles to be dried are inserted into the rotating drum of dryer 12. In FIG. 1, the power cord 14 of dryer 12 is shown in use with adapter 10 to connect the plug prongs 17 of the four-prong plug 16 of the newer, now required configuration to an outlet 24 having a receptacle with only three prong-receiving receptacle openings 25 of a different, non-conforming configuration. As set forth in more detail below, a typical configuration for the four-prong arrangement of plug 16 is shown in FIG. 3 and a typical three-prong arrangement to plug into outlet 24 is shown in FIG. 4. As will be readily apparent to those skilled in the art, other plug/opening configurations may also be utilized with adapter 10.

The adapter 10 of the present invention, best shown in FIGS. 2 through 4 and 6 through 9, comprises a body member 26 having an outward face 28 at a first end 30 and a rearward face 32 at a second end 34. In the preferred embodiment, the body member 26 is made out of a non-conductive material, such as plastic or an elastomer, as well known in the art, and has internal wiring to transmit the power from the outlet 24 to the dryer 12 through power cord 14. In the embodiment of FIGS. 1 through 4, the outward face 28 of adapter 10 has four prong-receiving openings, shown collectively as 36, that are configured in a first prong pattern 37 which corresponds to the pattern (being the number and/or configuration) of the four plug prongs 17 of plug 16. Each of the four prong-receiving openings 36 corresponds to one of the four prongs 17 on plug 16 of power cord 14 so that plug 16 may be plugged directly into the outward face 28 of adapter 10, with each of the plug prongs 17 received inside their respective prong-receiving openings 36. The rearward face 32 of adapter 10 of this embodiment has three outwardly extending adapter prongs 38 that are configured in a second prong pattern 39, as best shown in FIG. 4, that corresponds to the pattern (being the number and/or configuration) of the prong-receiving receptacle openings 25 of the receptacle utilized with outlet 24, such that each of the adapter prongs 38 are received inside their respective receptacle openings 25. As well known in the art, the adapter prongs 38 of adapter 10 may be made out of copper, brass or other electrically conductive material so as to transmit electricity from the outlet 24 to the power cord 14.

The prong-receiving openings 36, in first prong pattern 37, of the embodiment of FIGS. 1 through 4 include a ground opening 40 and a neutral opening 42 that are configured to receive the corresponding plug prongs 17 of plug 16 at the end of power cord 14. The three adapter prongs 38 extending rearward from adapter 10, in second prong pattern 39, do not include a prong 38 that corresponds to the ground opening 40, which is not utilized in the older style three prong outlet 24. Electrical conducting elements, such as bars, wires or the like, inside the body member 26 of adapter 10 interconnect three of the prong-receiving openings 36 on the outward face 28 of body member 26 with the three corresponding adapter prongs 38 on the rearward face 32 thereof. The three prong-receiving openings 36 and adapter prongs 38 that are connected will be the two power or hot wires, typically red and black, and the white or neutral wire, associated with the neutral opening 42 thereby leaving the one prong receiving opening which is associated with the green or ground wire, which is the ground opening shown as 40 in FIGS. 2 and 3, unconnected to an adapter prong 38 when adapter 10 is plugged into the receptacle of outlet 24. In effect the ground prong from the plug 16 of the power cord 14 will dead end or dummy into adapter 10 to provide the interconnection between the four-prong plug 16 and the three-opening receptacle of outlet 24.

In the embodiment of FIGS. 5 through 9, the outward face 28 of adapter 10 has three prong-receiving openings, shown collectively as 36, that are configured in a first prong pattern 37 which corresponds to the pattern of the three prongs 17 of plug 16. Each of the three prong-receiving openings 36 corresponds to one of the three prongs 17 on plug 16 of power cord 14 so that plug 16 may be plugged directly into the outward face 28 of adapter 10. In this embodiment, the rearward face 32 of adapter 10 has four outwardly extending adapter prongs 38, best shown in FIGS. 6, 8 and 9, that are configured in the same pattern as the prong-receiving openings 25 of the receptacle utilized with outlet 24. As well known in the art, the adapter prongs 38 of adapter 10 are made out of copper, brass or other electrically conductive material so that it may transmit electricity from the outlet 24 to the power cord 14.

The three prong-receiving openings 36 of the embodiment of FIGS. 5 through 9 include only the neutral opening 42, which is configured to receive the corresponding neutral prong component of plug 16 at the end of power cord 14. Although the four adapter prongs 38 extending rearward from adapter 10 include a prong that is received inside the ground opening utilized in the newer style receptacles of outlet 24 having four receptacle openings 25, this prong does not have a corresponding prong-receiving opening 36 on the outward face 28 of adapter body 26 or a plug prong 17 on plug 16. Various electrical conducting elements, such as bars or wires, inside the body member 26 of adapter 10 interconnect the three prong-receiving openings 36 on the outward face 28 of body member 26 with three corresponding adapter prongs 38 on the rearward face 32 thereof. The three prong-receiving openings 36 and adapter prongs 38 that are connected will be the two power or hot wires, typically red and black, and the white or neutral wire, associated with the neutral opening 42, thereby leaving the prong associated with the green or ground wire of the outlet unconnected to a prong-receiving opening 36 (i.e., not ground opening 40) when adapter 10 is plugged into the receptacle of outlet 24. As will be readily apparent to those skilled in the art if the adapter 10 is left this configuration it could present a safety hazard, namely electrocution, for the user of dryer 12.

Figure 7:
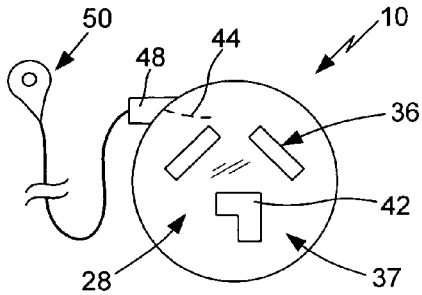
FIG. 7 is front view of the adapter of FIG. 6.
Figure 6:
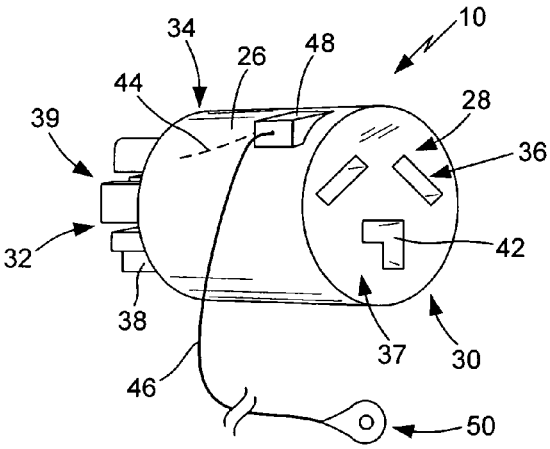
FIG. 6 is a perspective view of the adapter of FIG. 5.
Figure 8:
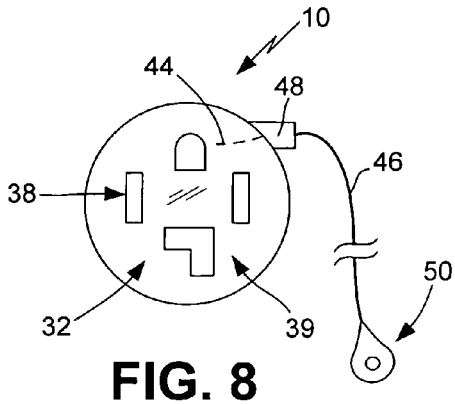
FIG. 8 is a back view of the adapter of FIG. 6.
Figure 9:
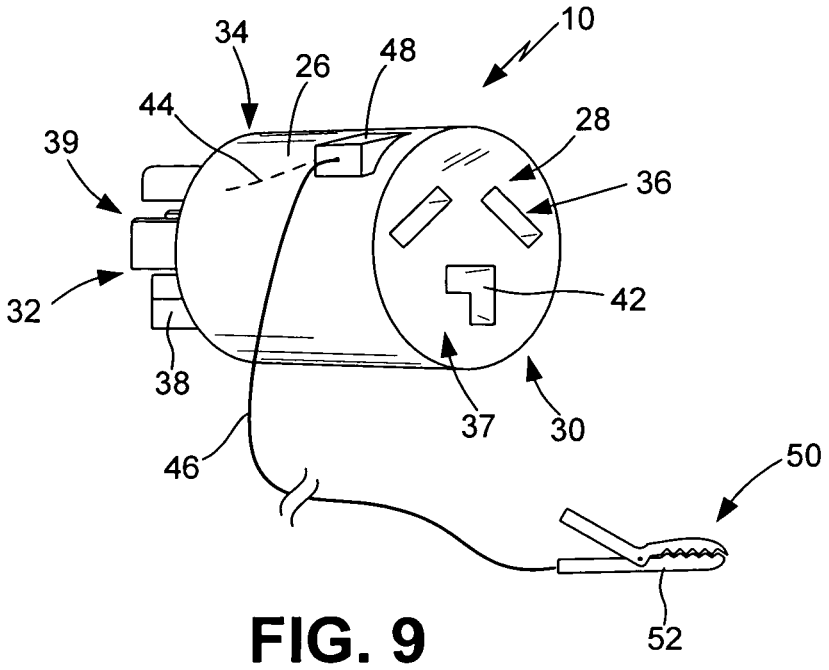
FIG. 9 is a perspective view of an alternative configuration of the adapter of FIG. 6 shown utilizing a clamp to connect the ground wire to the dryer.

To eliminate the safety hazard associated with not having the ground opening of the outlet 24 connected to the power cord 14, the present adapter 10 includes a means for connecting one of the adapter prongs 38 with a ground wire 46 that is connected to a metal component on the dryer 12. In a preferred embodiment the connecting means is a wire 44, best shown in FIGS. 6, 7 and 9, disposed inside body member 26 that interconnects the prong which is inserted into the ground opening of the receptacle of outlet 24 with a ground wire 46 that is connected to a grounding source, such as a metal component on the back end 18 of dryer 12. Alternatively, the connecting means can be any type of rod or other electrically conductive device that is associated with the body member 26 so as to ground the dryer 12. In one embodiment, ground wire 46 merely extends away from adapter 10 and the user connect the end of ground wire 46 with a metal component of dryer 10. In a preferred embodiment, however, the ground wire 46 extends outwardly from an extending mechanism 48 associated with the body member 26 (i.e., either disposed on the outside as shown or manufactured inside body member 26) and an attachment means 50 is provided at the distal end of ground wire 46 for attaching ground wire 46 to a metal component on dryer 12 (typically at the back end 18 of the dryer 12). Preferably, extending mechanism 48 is of the type that is automatically retractable to allow the user to extend ground wire 46 an amount necessary to contact the grounding source when adapter 10 is in use and which retracts ground wire 46 back inside when adapter 10 is not in use or which retracts that portion of the ground wire 46 which is not used, similar to the devices utilized for retractably holding keys and the like on a belt. Connecting wire 44 is electrically connected to the prong 38 on the rearward face 32 of adapter 10 that extends into the ground opening of the receptacle of outlet 24. With ground wire 46 attached to a metal component on the back end 18 of dryer 12, or elsewhere on dryer 10, to interconnect the ground of outlet 24, via the extending mechanism 48 and the connecting wire 44, to a ground location, dryer 12 will be sufficiently grounded to prevent an electrical shock hazard for the user of dryer 12. In the embodiments of FIGS. 6 through 8, the attachment means 50 is of the type which receives a screw or bolt to connect to dryer 12, such as a Y-shaped connector or the eyelet-shaped connector shown. In the embodiment of FIG. 9, attachment means 50 is clamp 52, a clip or like devices that releasably connect or attach to the back end 18 of dryer 12 to provide the necessary grounding.

To use the embodiment of FIGS. 1 through 4, the user merely connects the four prongs 17 of plug 16 of power cord 14 from dryer 12 into the four correspondingly shaped prong-receiving openings 36 on the outward face 28 of body member 26 and then plugs the three adapter prongs 38 extending outward from the rearward face 32 of body member 26 into the correspondingly shaped three receptacle openings 25 of the receptacle of outlet 24. As such, the adapter 10 of the present invention provides an easy to use, effective and safe device for connecting the four-prong plug 16 at the end of power cord 14 of dryer 12 to an outlet 24 having a receptacle with three receptacle openings 25. To use the embodiment of FIGS. 5 through 9, the user connects the three prongs 17 of plug 16 of power cord 14 from dryer 12 into the three correspondingly shaped prong-receiving openings 36 on the outward face 28 of body member 26 and then plugs the four adapter prongs 38 extending outward from the rearward face 32 of body member 26 into the four correspondingly shaped prong-receiving receptacle openings 25 of the receptacle of outlet 24. The user then connects ground wire 46 to a grounding source. In the preferred embodiment, the user pulls ground wire 46 out from the extending mechanism 48 for the desired length and then connects or otherwise attaches attachment means 50, such as the eyelet or clamp 52, to a metal component at the back end 18 of dryer 12. Any excess amount of the ground wire 46 that is not needed to extend to dryer 12, such as results when the dryer 12 is pushed back against the wall, is retracted into the extending mechanism 48. As such, the adapter 10 of the present invention provides an easy to use, effective and safe device for connecting the three-prong plug 16 at the end of power cord 14 of dryer 12 to an outlet 24 having a receptacle with four receptacle openings 25.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. An adapter comprising:

a body member having an outward face at a first end and a rearward face at a second end;

three prong-receiving openings in said outward face of said body member, said prong-receiving openings disposed in a first prong pattern in corresponding relation to three plug prongs on a power cord electrically connected to a dryer, said plug prongs on said power cord disposed in non-corresponding relation to four receptacle openings of an outlet such that direct connection of said power cord to said outlet is prevented;

four outwardly extending adapter prongs on said rearward face of said body member, said adapter prongs disposed in a second prong pattern in corresponding relation to said plurality of receptacle openings of said outlet so as to allow said power cord to electrically connect said dryer to said outlet when said plug prongs of said power cord are positioned in said prong-receiving openings of said adapter plug and said adapter prongs are positioned in said receptacle openings of said outlet; and a ground wire extending outwardly from said body member to connect to said dryer and a connecting means associated with said body member for electrically connecting one of said adapter prongs with said ground wire.

2. The adapter of claim 1 further comprising an attachment means on said ground wire for attaching said ground wire to said dryer.

3. The adapter of claim 2, wherein said attachment means comprises one or more eyelets.

4. The adapter of claim 2, wherein said attachment means is a clamp.

5. The adapter of claim 1 further comprising an extending means associated with said body member for retractably extending said ground wire from said body member to said dryer.

6. An adapter comprising:

a body member having an outward face at a first end and a rearward face at a second end;

three prong-receiving openings in said outward face of said body member, said prong-receiving openings disposed in a first prong pattern in corresponding relation to said plug prongs on a power cord electrically connected to a dryer, said plug prongs on said power cord disposed in non-corresponding relation to a plurality of receptacle openings of an outlet such that direct connection of said power cord to said outlet is prevented;

four outwardly extending adapter prongs on said rearward face of said body member, said adapter prongs disposed in a second prong pattern in corresponding relation to said receptacle openings of said outlet so as to allow said power cord to electrically connect said dryer to said outlet when said plug prongs of said power cord are positioned in said prong-receiving openings of said adapter and said adapter prongs are positioned in said receptacle openings of said outlet;

a ground wire extending outwardly from said body member to connect to said dryer;

connecting means associated with said body member for electrically connecting one of said adapter prongs to said ground wire; and attachment means on said ground wire for attaching said ground wire to said dryer.

7. The adapter of claim 6, wherein said attachment means comprises one or more eyelets.

8. The adapter of claim 6, wherein said attachment means is a clamp.

9. The adapter of claim 6 further comprising an extending means associated with said body member for retractably extending said ground wire from said body member to said dryer.

* * * * *